United States Patent [19]

Maingueneau

[11] Patent Number: 4,553,576

[45] Date of Patent: Nov. 19, 1985

[54] WOOD SPLITTING MACHINE WITH A THREADED ROTATING CONE

[75] Inventor: Gérard Maingueneau, Les Trois-Moutiers, France

[73] Assignee: Mecanique des Moutiers Route de Loudun, Les Trois Moutiers, France

[21] Appl. No.: 634,045

[22] Filed: Jul. 24, 1984

[51] Int. Cl.[4] ..... B27L 7/00

[52] U.S. Cl. ..... 144/194; 144/193 K

[58] Field of Search ..... 144/193 R, 193 K, 194, 144/366

[56] References Cited

U.S. PATENT DOCUMENTS 4,252,166 7/1981 Kozicki .

FOREIGN PATENT DOCUMENTS 2622072 6/1981 Fed. Rep. of Germany .
3135152 4/1983 Fed. Rep. of Germany .
2500358 3/1982 France .
2505224 5/1982 France .
2525950 11/1983 France ..... 144/194

*Primary Examiner*—W. D. Bray
*Attorney, Agent, or Firm*—Laff, Whitesel, Conte & Saret

[57] ABSTRACT

A log splitter has a rotatable cone driven by a reversible motor. A system of lever arms support a log in a V-shaped carrier positioned under the point of the cone. When the lever arm is operated, the log is pushed against the point of the rotating cone, which splits the log. If the log fails to split, the motor is driven in the reverse direction, which releases the log.

9 Claims, 4 Drawing Figures

WOOD SPLITTING MACHINE WITH A THREADED ROTATING CONE

The present invention relates to a machine for splitting wood, the machine being fitted with a rotating threaded cone, and more particularly, to such a machine for household use.

The use of a rotating threaded cone to split wooden logs has already been described in French Pat. Nos. 1,237,200; 2,345,273; 2,415,524; 2443,319; 2,373,938; and 2,462,979. In practice, all of the cones described in these patents are mounted on a horizontal axis. They are driven by the power outlet of a tractor or of some other piece of agricultural equipment. As a result, they cannot be used by a private party who has no tractor, or the like, and who may desire to split logs in his basement, his yard, or his garage.

One object of the present invention is to provide a splitting machine with a threaded cone, which is capable of being used by a private party, and which offiers a complete safety of operation and a remarkable facility of execution.

According to one characteristic of the invention, a machine is formed by a box. Inside the box, a threaded cone is directed downwardly and is supported, under the upper wall of the box, by a motor shaft driven by a driving means which can be governed. A log supporting plate is carried above the bottom wall of the box, and under the threaded cone, by a lifting means which can be governed. A horizontal lug piece enables a rotation of the logs.

According to another characteristic, the plate has the shape of an upwardly open dihedron, the edge of which is longitudinal.

According to another characteristic, the box is fitted with a door having a port equipped with electrical microcontacts which govern the operation of the electric motor.

According to another characteristic, the lifting means are composed of a lever, one end of which is fitted with an operating handle. The rotation axis or fulcrum of the lifting lever is supported by a tab hanging from the box. The other end of the lever is coupled, by means of a small connecting lever, to the lower end of a vertical rod. The other end of the vertical rod is affixed to the plate, the bar being guided in the vertical direction by a guiding means.

The characteristics of the invention which have been indicated above, as well as others, will appear more clearly from a reading of the following description of one embodiment. The description being given with respect to the attached drawings, in which.

Figure 1:
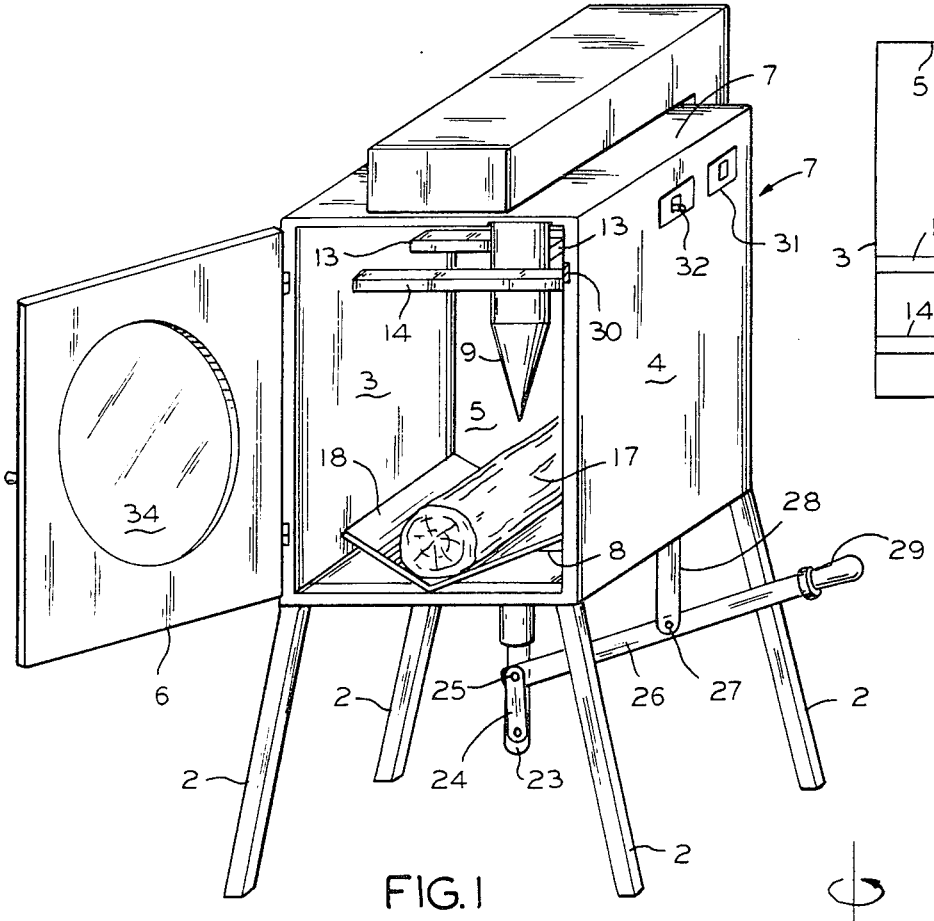
FIG. 1 is a perspective view of a machine, according to the present invention, the door of the machine being open.

In the embodiment of FIG. 1, the machine is composed of a box 1, mounted on four legs 2. Box 1 is in the shape of a parallelepipide, with two longitudinal vertical walls 3 and 4, a transverse vertical wall 5, a door 6, which when closed, forms the second transverse vertical wall, an upper wall 7 and crosspieces 8, which constitute the bottom.

Under the upper wall 7, there is a rotating and threaded cone 9, the point of which is directed downwardly. The alignment of shaft 10 (FIG. 2), for the driving of cone 9, is ensured by two roller bearings 11, the axis of which is vertical and the cages of which are mounted in a cylinder 12, which is supported by a horizontal crosspiece 13 fixed on wall 5 and two horizontal crosspieces including a front one 14, and a back one 15, mounted between walls 3 and 4. Shaft 10 is driven in rotation by an electrical motor associated with a reducing device, which are covered by a cover 16.

Since door 6 is open, there is seen in box 1, a log 17 resting on a V-shaped support 18. As seen in section in FIG. 2, the V-shaped support 18 is horizontally mounted at the end of a cylindrical rod 19, which runs down under the lower crosspieces 8, running through a cylindrical sleeve 20, which guides it vertically. Sleeve 20 is fixed in an intermediary crosspiece 8 by means of a support 21 mounted on the edge of the crosspiece by means of screws 22. The vertical axis of the sleeve 20 is aligned with the vertical axis of cone 9.

The lower end 23 of rod 19 is articulated on one end of a small connecting lever 24, the other end 25 of which is articulated on one end of a lever arm 26. Lever 26 is mounted in a pivoting manner or on a fulcrum formed by a shaft 27 carried by a tab 28 hanging from underneath wall 3. The other end of lever 26 is fitted with a handle 29. Handle 29 projects beyond wall 3.

Figure 3:
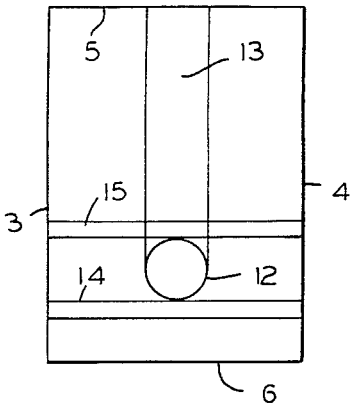
FIG. 3 is a schematic view from the top, showing the inside of the machine.

As seen in FIG. 3, the axis of cone 9 is at an equal distance between walls 3 and 4 for one part, and clearly closer to door 6 than to wall 5, the ratio of those uneven distances being approximately one to three.

The part of box 1 which forms the frame of door 6, is fitted with electrical microcontacts, schematically represented in 30, which cut off the current from motor 14 when door 6 is opened.

On wall 3, there is also a circuit breaker type of contact piece 31. Contact piece 31 makes it possible to feed motor 14. In case of a blocking of the motor or of too long a period of operation without load, circuit breaker 31 cuts off the current.

Beside circuit breaker 31, there is also an inverter contact 32 which makes it possible to choose the normal or reverse direction of rotation of motor 14. The motor may be either monophased or triphased.

Door 6 is fitted with a handle 33 and has a center window 34.

Between sleeve 20 and rod 19 are guiding rollers 35.

In operation, the machine is assumed to be connected to a source of electrical current. The circuit breaker type switch 31 is engaged, the door 6 is opened, and a log 17 is placed on support 18. Door 6 is then closed. Handle 29 is lowered.

Figure 2:
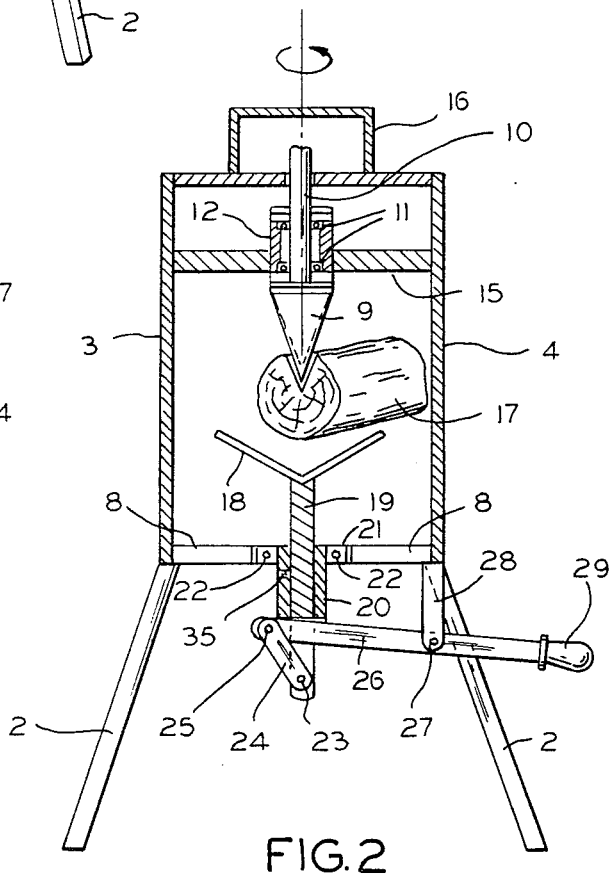
FIG. 2 is a view, in transverse cross section, of the machine in FIG. 1, cut along line II—II.

Lever 26 pivots, lifting the small connecting lever 24 and, therefore, rod 29. Support 18 is raised so that the upper generatrix of the log 17 comes into contact with the tip of the threaded cone 9. That point follows a spiral path into log 17, which continues to rise while the cone is penetrating it. Handle 29 can be released. The log tends to place itself crosswise in the box 1 (as seen in FIG. 2), but the distance between walls 3 and 4 is less than the length of the log, so that the rotation of the log under the impact of the cone is blocked. When, through port window 34, it is seen that the log has been split, door 6 is opened, which stops the motor and the rotation of cone 9. It is possible to remove the pieces of wood.

Should the point of cone 9 start boring through a knot, it is possible that it would become blocked there. That situation can be observed either by looking through port window 34, or because circuit breaker 31 has disconnected the circuit. In order to easily separate the log from the point, it is then sufficient to operate the inverter switch 32 and to reconnect circuit breaker 31. By rotating the motor in a reverse direction, the cone will, by itself, become unscrewed from the log.

It seems that on the basis of the preceding description, the invention offers all guarantees of safety. In addition, the force to be exerted on the handle need not be important, for one part because of the choice of the lever arms and, also, because of rollers 35 which prevent any jamming of rod 19 inside 20.

Figure 4:
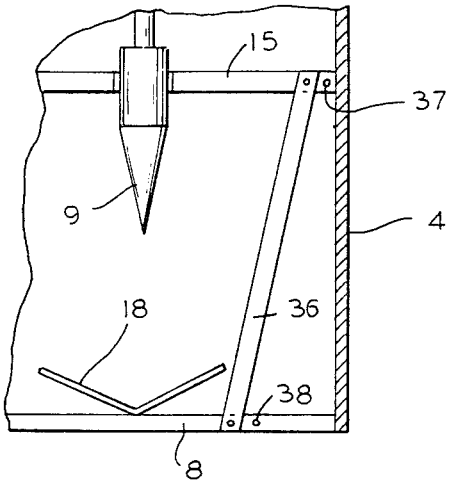
FIG. 4 is a schematic view of the assembling of a lug piece for stopping rotation.

As seen in FIG. 4, when the logs are too short to become blocked by rotation against wall 4, there is the possibility of placing a slanter bar 36 between small crossbar 15 and the intermediary crossbar 8. To that end, crossbars 15 and 8 are pierced with holes 37 and 38, respectively. The ends of bar 36 also are pierced, so that it is possible to fix bar 36 with suitable pins between a pair of holes 37, 38. In practice, the pairs of holes 37, 38 are plaed in a manner such that bar 35 will form, with the vertical, an angle which is equal to one-half the angle of the summit of the cone. Bars 35 may be placed as close as possible to the cone, as a function of the length of the logs to be split.

It has already been indicated above that the axis of cone 9 was closer to door 6 than to wall 5. Indeed, cone 9 then does not work at the center of the log, but at a point which is closer to one of its ends, which makes it possible to reduce the power of the motor and, therefore, of its cost.

Those who are skilled in the art will readily perceive how to modify the invention. Therefore, the appended claims are to be construed to cover all equivalent structures which fall within the true scope and spirit of the invention.

I claim:

1. A log splitter comprising a closed box having a vertically positioned cone splitter rotatably mounted with its point extending downwardly in a vertical direction, motor driven means for rotating said cone splitter, a V-support beneath said cone for supporting a log in a horizontal position with the cross section of the log centered under said cone splitter, and elevator means for raising said V-support to engage said cone splitter.

2. The log splitter of claim 1 wherein said box is too small relative to the length of said log for said log to rotate freely under the impact of the rotation of said cone splitter.

3. The log splitter of claim 2 and means in said box for inhibiting the free rotation of said log under the impact of the rotation of said cone splitter.

4. The log splitter of claim 1 and lever means outside of said box for raising and lowering said elevator means.

5. The log splitter of claim 1 and means for reversing the direction of rotation of said cone splitter for freeing said splitter from said log.

6. The log splitter of claim 5 wherein said driven means is an electrical motor and said means for reversing the direction of rotation is means for reversing the direction of said motor means.

7. The log splitter of claim 1, wherein the elevator means includes a lever arm outside of said box, one end of said arm being fitted with a handle for operating the lever, a central part of the arm being supported by a tab hanging downwardly from the box, and the other end of said arm being coupled through a small connecting lever to the lower end of a vertical sliding rod, the other end of said rod being affixed to said V-support, the rod being vertically guided by a guiding means formed in the bottom of said box.

8. A log splitter comprising a closed box having a vertically positioned cone splitter rotatably mounted with its point extending downwardly, motor driven means for rotating said cone splitter, said driven means being an electrical motor and means for reversing the direction of cone rotation by reversing the turning direction of said motor means, a V-support beneath said cone for supporting said log in a horizontal position with the cross section of the log centered under said cone splitter, and elevator means comprising a lever arm for raising said V-support to engage said cone splitter, said box being too small relative to the length of said log for said log to rotate freely under the impact of the rotation of said cone splitter.

9. The log splitter of claim 8, wherein the elevator means includes a lever arm, one end of said arm being fitted with a handle for operating the lever, the arm of said lever moving about a fulcrum formed by a support tab hanging downwardly from the box, and the other end of said arm being coupled through a connecting lever to the lower end of a vertical rod, the other end of said rod being affixed to said V-support, the rod being vertically guided by a guiding means formed in the bottom of said box.

* * * * *